US006039019A

United States Patent [19]

Breidenbach

[11] Patent Number: 6,039,019

[45] Date of Patent: Mar. 21, 2000

[54] VALVE DRIVE ARRANGEMENT FOR INTERNAL COMBUSTION ENGINES

[75] Inventor: Paul Breidenbach, Bechenheim, Germany

[73] Assignee: General Motors Corporation, Detroit, Mich.

[21] Appl. No.: 09/295,298

[22] Filed: Apr. 20, 1999

[30] Foreign Application Priority Data

May 8, 1998 [DE] Germany ..... 198 20 541

[51] Int. Cl.[7] ..... F01L 1/14

[52] U.S. Cl. ..... 123/90.61; 123/308; 123/193.5

[58] Field of Search ..... 123/90.61, 193.5, 123/193.3, 306, 308, 432

[56] References Cited

U.S. PATENT DOCUMENTS

| | | | |
|---|---|---|---|
| 2,930,366 | 3/1960 | Kolbe | 123/90.61 |
| 3,276,438 | 10/1966 | Keinath | 123/59 |
| 3,605,704 | 9/1971 | Gardner | 123/90.61 |
| 4,811,702 | 3/1989 | Oppie et al. | 123/188.14 |
| 4,930,468 | 6/1990 | Stockhausen | 123/188.14 |
| 5,669,347 | 9/1997 | Cullen et al. | 123/306 |

FOREIGN PATENT DOCUMENTS

4244726 A1 5/1994 Germany .

*Primary Examiner*—Weilun Lo
*Attorney, Agent, or Firm*—Laura C. Wideman

[57] ABSTRACT

The invention pertains to a valve drive arrangement for an internal combustion engine comprising cylinders each having an intake valve and an intake channel leading to the intake valve. The intake channel is divided into two partial channels near the cylinder. One of the partial channels may also be made switchable by including a switchable flow blocking device. A rocker arm acts on the valve and a push rod is arranged between an in-block camshaft and the rocker arm. The push rod activating the rocker arm for the intake valve is guided by a passage between the two partial channels of the intake channel. In this way, despite the restricted space in the cylinder head, both partial channels are designed relatively wide and well adapted to the flow required.

4 Claims, 1 Drawing Sheet

VALVE DRIVE ARRANGEMENT FOR INTERNAL COMBUSTION ENGINES

TECHNICAL FIELD

The invention pertains to a valve drive arrangement for internal combustion engines.

BACKGROUND OF THE INVENTION

Valve drive arrangements, in which the push rod may be decoupled from the camshaft in its action in order to make one of the valves actuated by it stationary, are known. The space in the cylinder head for arrangement of gas exchange channels, especially the intake channels, is restricted by the push rods. Special problems arise if two separate intake channels are to be guided to one cylinder in order, for example, to be able to optionally switch off one of the intake channels.

SUMMARY OF THE INVENTION

The objective of the invention is to improve a valve drive arrangement of this type in such a way that the arrangement of two partial channels for gas supply to each cylinder is simplified and the shape of the channel optimized.

By passing the push rod for actuation of one or more intake valves between the two partial channels, the space on both sides of the passage for guiding the push rod in the cylinder head is utilized for the width of the partial intake channels. The cross section of each partial channel can therefore be given a flow-promoting shape. A switchable flow blocking device such as a throttle flap, may be provided in such a cross section.

DESCRIPTION OF THE PREFERRED EMBODIMENT

Figure 1:
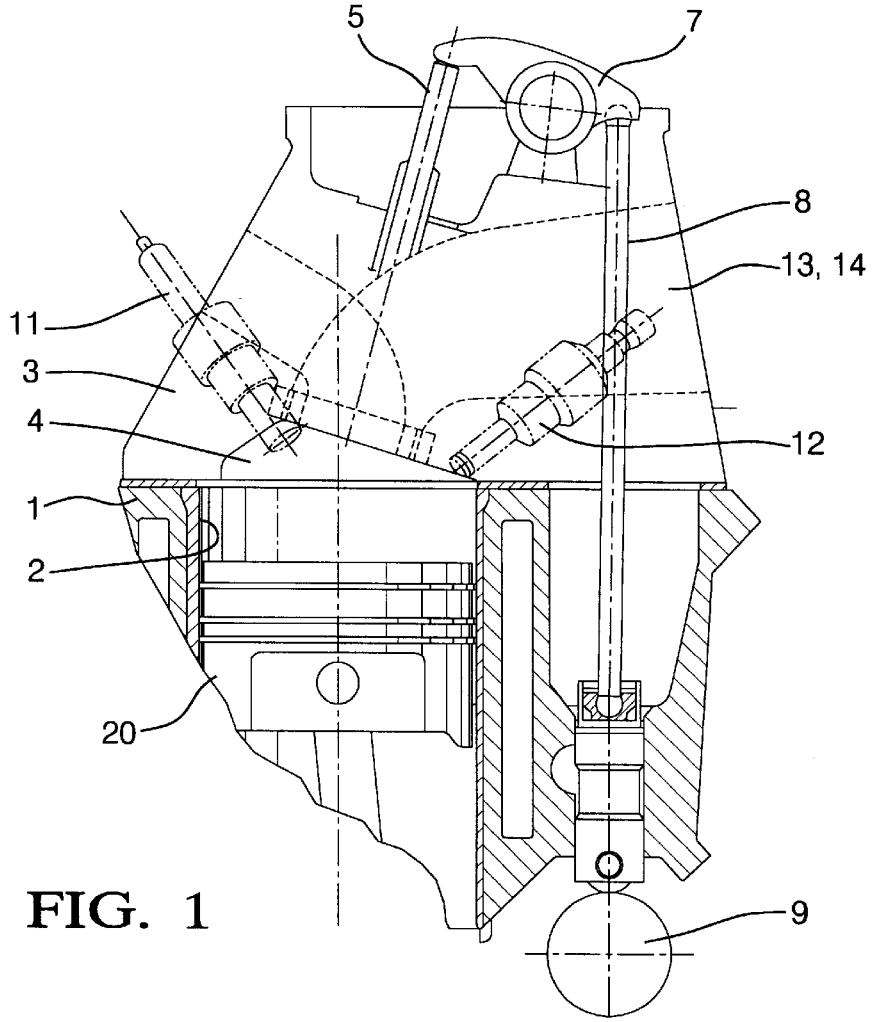
FIG. 1 is a schematic sectional, side view of a valve drive arrangement according to the invention.

As shown in FIG. 1, a cylinder block 1 of an internal combustion engine includes cylinder 2, which is closed at the top by a cylinder head 3, and in each of which a piston 20 is movably guided. A combustion chamber 4 is formed between the piston 20 and the cylinder head 3. The combustion chamber 4 is provided with an intake valve 5 and an exhaust valve 6, FIG. 2. A camshaft 9, mounted in the cylinder block 1, acts upon a push rod 8 to push on a rocker arm 7. The rocker arm 7 actuates the intake valve 5 against the force of a valve spring, not shown. The exhaust valve 6 is also actuated by a rocker arm, not shown, on which an exhaust push rod 10 acts. A spark plug 11 and a fuel injection valve 12 extend into the combustion chamber 4.

Figure 2:
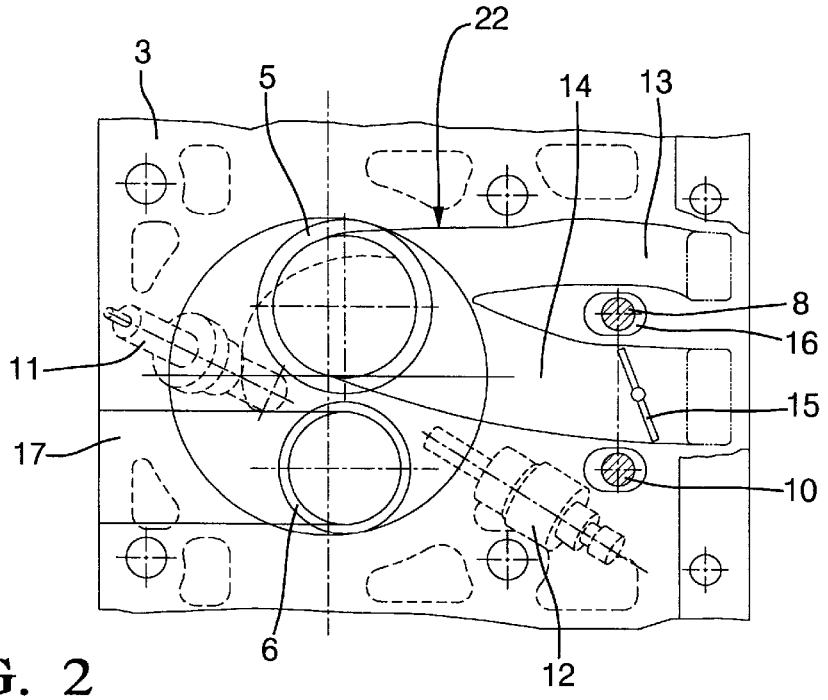
FIG. 2 is a sectional plan view of the valve drive arrangement in FIG. 1.

As shown in FIG. 2, an intake channel 22 is provided leading to the intake valve 5. Where the intake channel 22 bends away from the cylinder 2, the intake channel is divided into two partial channels, a non-switchable partial channel 13 and a switchable partial channel 14. A switchable flow blocking device in the form of a throttle flap 15 is arranged in the switchable partial channel 14. The switchable partial channel 14 extends intermediate the two push rods 8, 10 while the non-switchable partial channel 13 extends along the other side of the push rod 8. The push rod 8 for the intake valve 5 therefore lies in a passage 16 which is located in the cylinder head 3 in the material between the two partial channels 13,14 of the intake channel 22. An exhaust gas channel 17 leads away from exhaust valve 6.

With the invention, an internal combustion engine having a camshaft 9 in the block 1 may be equipped in a relatively optimal manner with two separate intake channel portions 13,14. One of the partial channels 14 may also be switchable so that for different operating states of the internal combustion engine, either one partial channel or both partial channels may be used for filling the cylinder 2 and also for forming the gas vortex in the combustion chamber 4. Also, conditions for direct fuel injection are provided for engines with in-block camshafts.

I claim:

1. Valve drive arrangement for an internal combustion engine comprising cylinders each having an intake valve, an intake channel leading to the intake valve, the intake channel divided into two partial channels near the cylinder, a rocker arm acting on the valve, and a push rod arranged between an in-block camshaft and the rocker arm, wherein the push rod activating the rocker arm for the intake valve is guided by a passage between the two partial channels of the intake channel and wherein at least one partial channel of each intake channel includes a switchable flow blocking device.

2. Valve drive arrangement for an internal combustion engine comprising cylinders closed by a cylinder head and forming a combustion chamber therebetween, each cylinder having an exhaust valve and an intake valve, an intake channel leading to the intake valve, where the intake channel bends away from the cylinder the intake channel is divided into two partial channels, a nonswitchable partial channel and a switchable partial channel having a switchable flow blocking device, a rocker arm acting on the intake valve, and a push rod arranged between an in-block camshaft and the rocker arm, wherein the push rod activating the rocker arm for the intake valve is guided by a passage between the two partial channels of the intake channel.

3. Valve drive arrangement as in claim 2, further including an exhaust push rod for actuating the exhaust valve wherein the switchable partial channel extends intermediate the exhaust push rod and the push rod for the intake valve.

4. Valve drive arrangement as in claim 3, further including a spark plug and a fuel injection valve extending into the combustion chamber.

* * * * *